United States Patent [19]

Gill, Jr. et al.

[11] 4,141,180

[45] Feb. 27, 1979

[54] POLISHING APPARATUS

[75] Inventors: Gerald L. Gill, Jr., Scottsdale; Philip J. Rioux, Glendale, both of Ariz.

[73] Assignee: Kayex Corporation, Rochester, N.Y.

[21] Appl. No.: 835,295

[22] Filed: Sep. 21, 1977

[51] Int. Cl.[2] ..... B24B 7/00

[52] U.S. Cl. ..... 51/5 R; 51/124 R; 51/131 D

[58] Field of Search ..... 51/4, 5 R, 124 R, 126, 51/131 C, 131 D, 134

[56] References Cited

U.S. PATENT DOCUMENTS

| | | | |
|---|---|---|---|
| 2,493,206 | 1/1950 | Okey | 51/134 |
| 3,611,654 | 10/1971 | Weber | 51/131 C |
| 3,841,028 | 10/1974 | Katzke | 51/131 C |
| 3,913,271 | 10/1975 | Boettcher | 51/134 |
| 4,009,539 | 3/1977 | Day | 51/131 C |

*Primary Examiner*—Nicholas P. Godici
*Attorney, Agent, or Firm*—Lloyd F. Seebach

[57] ABSTRACT

The polishing apparatus utilizes a pressure head that imparts rotary motion to a wafer to be polished during the polishing operation and is of such a structure as to eliminate the need for the use of any bonding agent for holding the wafer in intimate contact therewith. In this apparatus, the head picks up a single, thin, flat wafer of a semiconductive material in a manually loaded pickup station, holds the wafer thereon as it is selectively moved into one of two polishing stations and then into a receiving station. The pickup and holding of the wafer on the head as it is moved from one station to another and positioned therein is accomplished with a vacuum applied to the head. Two separate polishing surfaces are used, one being for primary stock removal and the other for cosmetic or secondary polishing. Means is provided which enables the operator to selectively control the cycle time, the pressure applied to the wafer, the rate of flow of polishing agents, etc. This control can also be programmed to vary or change the cycle. The pressure head is automatically cleaned after completion of each cycle, to assure proper contact with the next wafer to be processed.

5 Claims, 9 Drawing Figures

POLISHING APPARATUS

FIELD OF THE INVENTION

The invention relates to polishing apparatus and, more particularly, to such apparatus in which a thin, flat wafer of a semiconductive material is retained for movement and polishing without the use of a bonding agent for securing the wafer to a carrier or pressure head.

DESCRIPTION OF THE ART

It has been the practice for some time to utilize a bonding agent, such as, resin, wax, etc., to hold an element, such as a piece of glass, on a head in a fixed and secure position while a surface of the element is being polished. In many instances, particularly, in the grinding and polishing of optical elements, such as lenses, a plurality of lenses are usually mounted on a head by such bonding agents so as to polish a number of surfaces simultaneously. The disadvantage of such multiple surface polishing is that when a lens or one of the elements being polished breaks away from the polishing head, it invariably causes damage to some of the other elements also mounted on the head. In many cases, all of such elements on the head can be damaged. Accordingly, for the polishing of thin, flat wafers of a semiconductive material, it has been the practice to follow the teachings of the glass polishing art. It is well known that semiconductive materials are very costly and, when such material is cut or sliced into wafers which can vary from 0.0010" to 0.0020" in thickness, the cost factor is such that the possibility of breakage and damage necessitates the need for a polishing apparatus which does not utilize multiple polishing or a bonding agent for retaining the wafers on a polishing head.

In order to overcome these disadvantages, it has been determined that a better procedure is to polish wafers of semiconductive material on an individual basis and to devise some way of holding the wafer in contact with a head so as to eliminate as much as possible, if not completely, the breakage and damage that has been prevalent in known apparatus. For this reason, in the present invention, the thin, flat wafer of semiconductive material is retained on a head with the use of a special material having a high level of friction. Also, the wafer is confined to a predetermined area of the head even as it is rotated. Any wafer breakage rate is much lower because there is no secondary effect, whereby a broken wafer can move into contact with another wafer to damage it as in the case with conventional multiple element polishers. One other factor that is of paramount importance, there is no possibility of a taper being introduced to the surface of the wafer being polished. Since no bonding agent is utilized, it is not necessary to clean the wafer, after having been polished, because the polished surface is in no way contaminated by a dewaxing solution or by a precleaning solution. Further, after inspection of the wafer surface, it can be moved directly into a scrubbing station in which the polished surface is merely cleaned of any polishing compound that may be still on the surface.

SUMMARY OF THE INVENTION

It is an object of the invention to provide a polishing apparatus for a thin, flat wafer of semiconductive material in which the wafer is retained on a head without the use of a bonding agent, thereby eliminating any need for precleaning the surface to be polished or cleaning the polished surface to remove any traces of the bonding agent.

Another object of the invention is to provide a polishing apparatus in which a thin, flat wafer of semiconductive material can be moved selectively into either or both of two polishing stations and, in one of the stations, having the wafer not only rotated but oscillated with respect to the polishing surface against which the wafer is being held.

Still another object of the invention is to provide a polishing apparatus utilizing a pressure head for holding a thin, flat wafer of semiconductive material thereon without the use of a bonding agent and which permits the wafer to move within the confines of the head while being rotated.

Yet another object of the invention is to provide a polishing apparatus for a thin, flat wafer of semiconductive material in which a pressure head on which the wafer is retained is subjected to a cleaning operation prior to pickup of the wafer that is to be polished.

And yet another object of the invention is to provide a polishing apparatus for a thin, flat wafer of semiconductive material in which the wafer is polished singly and does not need to be categorized by thickness prior to loading and processing by the polisher.

Other objects and advantages of the invention will be apparent to those skilled in the art by the description that follows.

The above objects of the invention are attained by a polishing apparatus for a thin, flat wafer of semiconductive material in which a plurality of stations are arranged in angularly spaced and circular relation to a common axis. The wafer is picked up in a pickup or supply station and selectively moved into engagement with a polishing surface in a primary station and/or a secondary or cosmetic station, and after the polishing operation has been completed in either or both of the stations, is then moved and deposited in a receiving station. The polishing surfaces in the primary and secondary stations are continuously rotated and a slurry of an abrasive cutting or polishing compound is continuously applied thereto during the polishing operation. The wafer is retained by a pressure head which is pivotally mounted with respect to the common axis and movable over the respective stations. In each of the primary and secondary stations, the carrier is actuated pneumatically to position and holds the wafer in contact with the respective polishing surface with a predetermined pressure. The programming is such that the primary and secondary stations can be used individually or successively. In addition, the carrier moves the pressure head into a cleaning station, after having deposited the wafer in a receiving station, for scrubbing the wafer contacting surface of the head prior to picking up the next wafer. The carrier and pressure head structure is unique in that it permits the application of a liquid, such as water, to the wafer contacting surface of the pressure head to enhance adhesion of the wafer to the surface, permits the wafer to be picked up and transported between stations by means of vacuum, and also permits the application of water and/or air under slight pressure to the head to eject the wafer therefrom when the carrier positions the pressure head in the receiving station after the polishing operation has been completed. In addition, the pressure head not only holds the wafer in intimate contact with the head, but, since the head is continuously rotated, also imparts rotation to the wafer.

At the same time, when the carrier moves the pressure head toward the polishing surface in the primary station or toward the polishing surface in the secondary or cosmetic station, the wafer is positioned in contact with the respective polishing surface with a predetermined pressure as determined by pneumatic means actuating or moving the pressure head. To eliminate excessive movement of the wafer relative to the pressure head, the wafer is confined to a predetermined area of the polishing surface by a ring of a buffer material, such as, a soft plastic material on the head which confines the wafer to the area. As a result, the wafer cannot be moved out of the confined of the pressure head ring due to any unforeseen force that may develop as a result of rotation of the wafer, rotation of the pressure head, and/or rotation of the polishing surface. The movement of the carrier over and with respect to the different stations, as well as in a vertical direction for engaging the wafer to pick it up, for holding the wafer in contact with a polishing surface at a predetermined pressure during the polishing operation, for moving the wafer toward the receiving station where the wafer is ejected and for moving and holding the wafer contacting surface of the pressure head in contact with the cleaning brush is accomplished by control means which includes a number of switches associated with the carrier head and suitable electrical circuitry.

As a result, the polishing apparatus disclosed herein and forming a part of the invention provides a very versatile system which is provided with safety interlocks and which can accommodate wafers not only of different diameter but also in a wide range of thickness. Since the wafers are polished singly, they do not need to be categorized by thickness prior to placing in the pickup station. The pickup and processing of a variety of wafer diameters can be accomplished by vertically interchangeable adapters. Further, control in the field in order to eliminate polishing in the primary station, to change cycle and/or to change the cycle time can be readily adjusted by the operator. Such changing or programming of the operation allows rapid reclamation of scratched or dirty wafers and cosmetic touchup of hard to clean wafers. Also, the polishing apparatus lends itself to operation by a single operator and requires only occasional maintenance for changing the material on the pressure head, possibly programming for a different diameter and thickness of wafer and maintaining a full vessel of the slurry of abrasive or cutting compound.

DESCRIPTION OF THE DRAWINGS

Reference is now made to the accompanying drawings, wherein like reference numerals designate like parts and wherein.

DESCRIPTION OF THE PREFERRED EMBODIMENT

Figure 3:
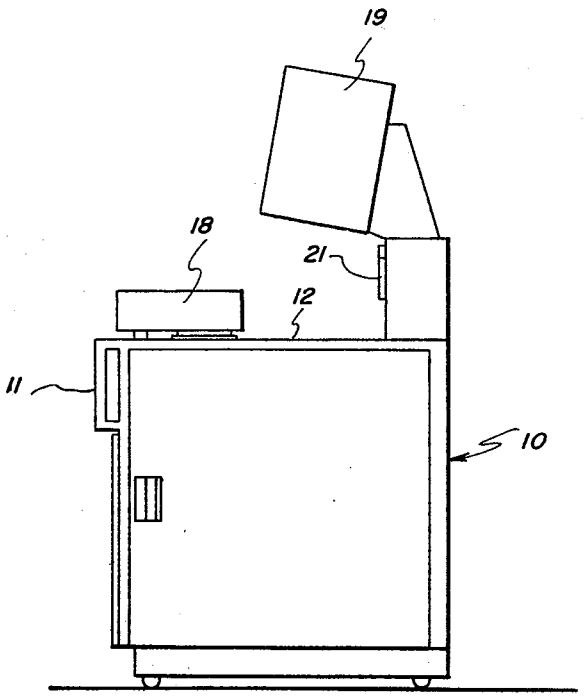
FIG. 3 is a side elevational view of the polishing apparatus shown in FIG. 1.
Figure 1:
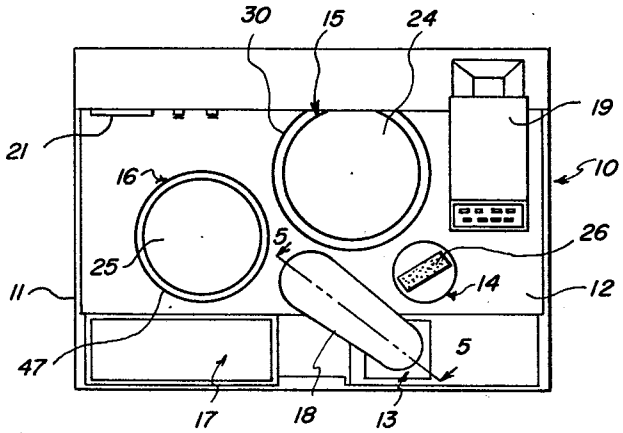
FIG. 1 is a plan view of the polishing apparatus in accordance with the invention showing the arrangement of the different stations and the carrier movable thereover.
Figure 2:
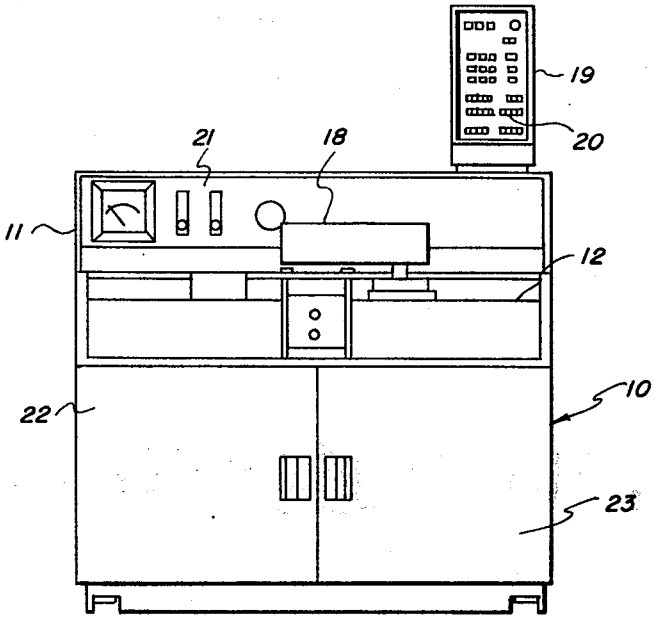
FIG. 2 is a front elevational view of the polishing apparatus shown in FIG. 1.

With reference particularly to FIGS. 1-3, the polishing apparatus generally designated by the numeral 10 is contained in and mounted on a cabinet 11. As shown in FIG. 1, the top surface 12 of the cabinet 11 is provided with several stations including a pickup station generally designated by the numeral 13, a cleaning station 14, a primary polishing station 15, a secondary or cosmetic polishing station 16, and a receiving station 17. A carrier generally designated by the numeral 18 is rotatably mounted for movement about a common axis, such as a hollow, cylindrical post as described more fully hereinafter, for moving a thin, flat wafer W of semiconductive material from the pickup station 13 over the cleaning station 14, over and into contact with the primary polishing station 15, over and into contact with the secondary polishing station 16, and, if so programmed, to the receiving station 17. The cabinet 11 also includes a housing 19 which contains various operating buttons 20 and switching circuitry for controlling the cycle of operation of the apparatus. The cabinet 11 also contains various other controls mounted on a faceboard 21. The cabinet 11 is also provided with doors 22 and 23 which provide access to the interior of the cabinet in which the operating mechanisms are contained. As shown in FIG. 1, the polishing surfaces 24 and 25, respectively, comprise a disk of an abrasive material, each of which is continuously rotated in a clockwise direction as viewed in FIG. 1. The cleaning station 14 includes a rotatable brush 26 for a purpose to be described hereinafter. As is well known in the polishing art, a slurry of an abrasive cutting or polishing compound can be applied to the polishing surfaces 24 and 25 in any suitable manner known in the art so long as the surfaces 24 and 25 are completely wetted by such slurry.

Figure 4:
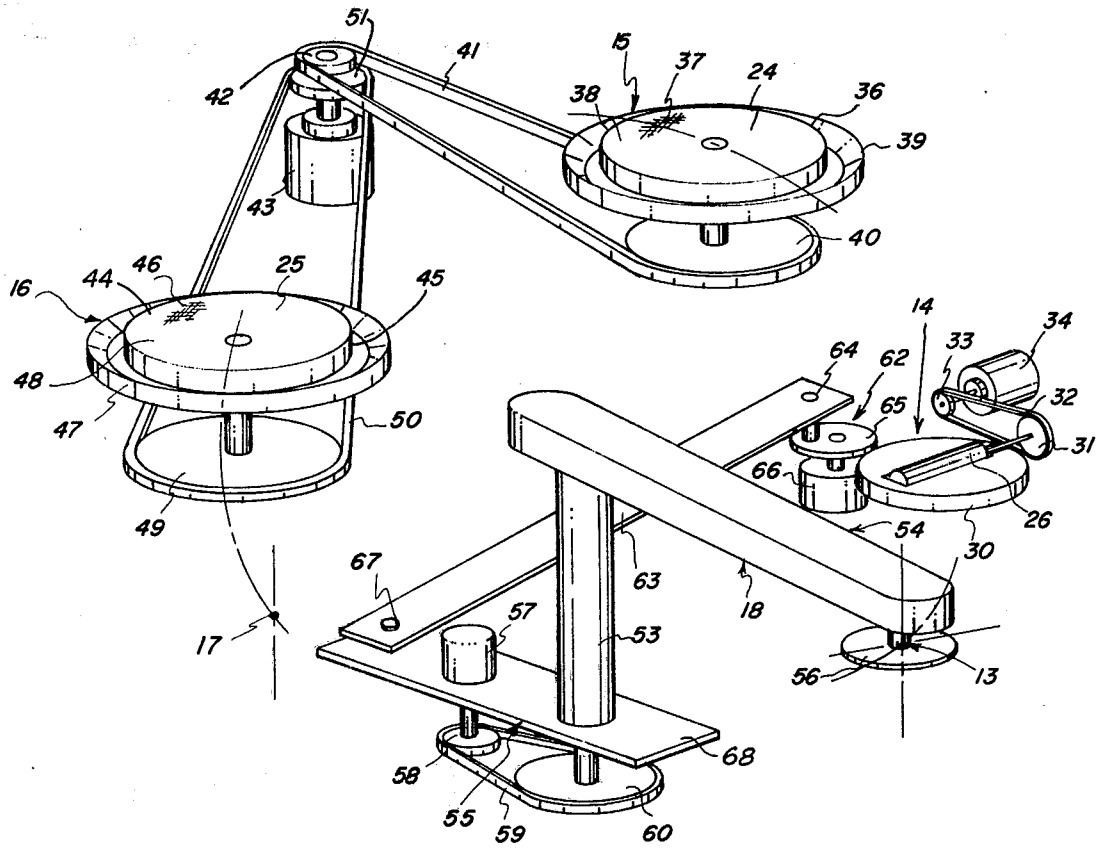
FIG. 4 is a perspective view which shows schematically the arrangement of the different stations and means in each station by which various members are driven or rotated.

With reference to FIG. 4, the cleaning station 14 comprises a trough 30 within which the brush 26 is rotatably mounted. The brush 26 is connected outside of trough 30 to a pulley 31 which, in turn, is connected by a belt 32 to a pulley 33 on the shaft of a motor 34. Obviously, the interconnection to brush 26 for rotating the same can be made in other ways; for example, by a direct gear drive, by a sprocket drive, or by directly coupling the shaft of motor 34 to the shaft on which brush 26 is carried.

The primary polishing station 15 includes a disk 36 that is covered with a material 37 that has an exposed abrasive surface 38 for polishing the surface of the thin, flat wafer W of semiconductive material. The abrasive factor of the surface 38 will be dependent on the type of semiconductive material that is to be polished. The disk 36 is mounted within a circular retainer or pan 39 for receiving the slurry of cutting compound that is applied to the surface 38 and spun off during the polishing operation. This slurry is, as is well known in the art, recoverable and can be reused, after filtering or being subjected to other treatment before use, if at all possible. The disk 36 is continuously rotated by means of pulley 40 interconnected thereto and which, in turn, is driven by a belt 41 which connects a pulley 42 associated with a motor 43 to the pulley 40. As mentioned above with respect to cleaning station 14, the drive can be accomplished in a number of different ways.

In a like manner, a disk 45 in the secondary or cosmetic polishing station 16 is also covered with a material 46 which has an exposed abrasive surface 44, this surface being somewhat finer than that of the material 37 used in the primary station 15. The disk 45 is also mounted within a retainer or pan 47 which receives the slurry of cutting compound applied to the surface 48 of the material 46 and spun off during the polishing operation. The disk 45 is interconnected to a pulley 49 which, by means of a belt 50, is connected to pulley 51 also associated with the motor 43. As with the disk 36 in the primary station, the disk 45 in the secondary station is also rotated continuously by motor 43. The speed at which the disks 36 and 45 are rotated may or may not be the same, depending on the wafer W being polished, the degree of abrasiveness of the materials 37, 46 covering each of the disks 36, 45, and the rate at which the polishing operation is desired to be accomplished.

The carrier 18 is mounted for rotation with respect to the axis 53 of a hollow shaft as shown in FIG. 4. A more detailed description of the carrier 18 follows hereinafter. However, at this point, it is desired to show that the carrier 18 comprises an upper structure 54 and a lower structure generally designated by the numeral 55. The upper structure 54 includes a pressure head, designated generally by the numeral 56, at its free end, and this head carries the wafer W as it is moved in a vertical direction when in each station or in an arcuate path from the pickup station 13 through the cleaning station 14, the primary station 15, the secondary station 16, and into the receiving station 17. The pressure head 56 is continuously rotated by a drive means best shown in FIG. 5, when it is in each of the primary, secondry and cleaning stations, and is moved relative to the aforementioned stations 13 - 17 by means of a drive means comprising a motor 57, a pulley 58, a belt 59, and a pulley 60 which is interconnected to the structure within the common axis designated by 53 and will be described more fully hereinafter.

Also associated with the carrier 18 is an oscillating mechanism 62 which comprises a link or arm 63 pivotally connected at one end 64 to an eccentric 65 rotatable by a motor 66. The other end of the arm 63 is pivotally connected to a plate 68 at one of several points 67 for oscillating the plate 68 about the common axis 53 at various amounts depending on the diameter of the wafer. The oscillating motion imparted to the plate 68 is also imparted on the pressure head 56.

In operation, the carrier 18, including the structures 54 and 55, is moved about the common axis 53, the wafer W being picked up in the pickup station 13 by vacuum, the vacuum holding the wafer to the underside of the pressure head and then moving the wafer into the primary station 15. The wafer W is then lowered into contact with the polishing surface 38 at a point between the axis of rotation of the disk 36 and its periphery. After the polishing operation has been completed in this station, the vacuum is again applied to hold the wafer in contact with the pressure head as it is raised for movement into either the cosmetic station 16 for further polishing or directly into the receiving station 17. At this point, it should be pointed out that the pressure head 56 has a stream of liquid, such as water, applied to it prior to pickup of the wafer W in order to wet the wafer contacting surface of a material on the surface of the pressure head so as to enhance adhesion of the water W to such surface. Also, water or a source of air under slight pressure is applied to the pressure head 56 when the carrier 18 is in the receiving station 17 in order to eject the wafer W from the wafer contacting surface of the pressure head. The structure of the pressure head will be readily apparent from the description which follows.

Figure 5:
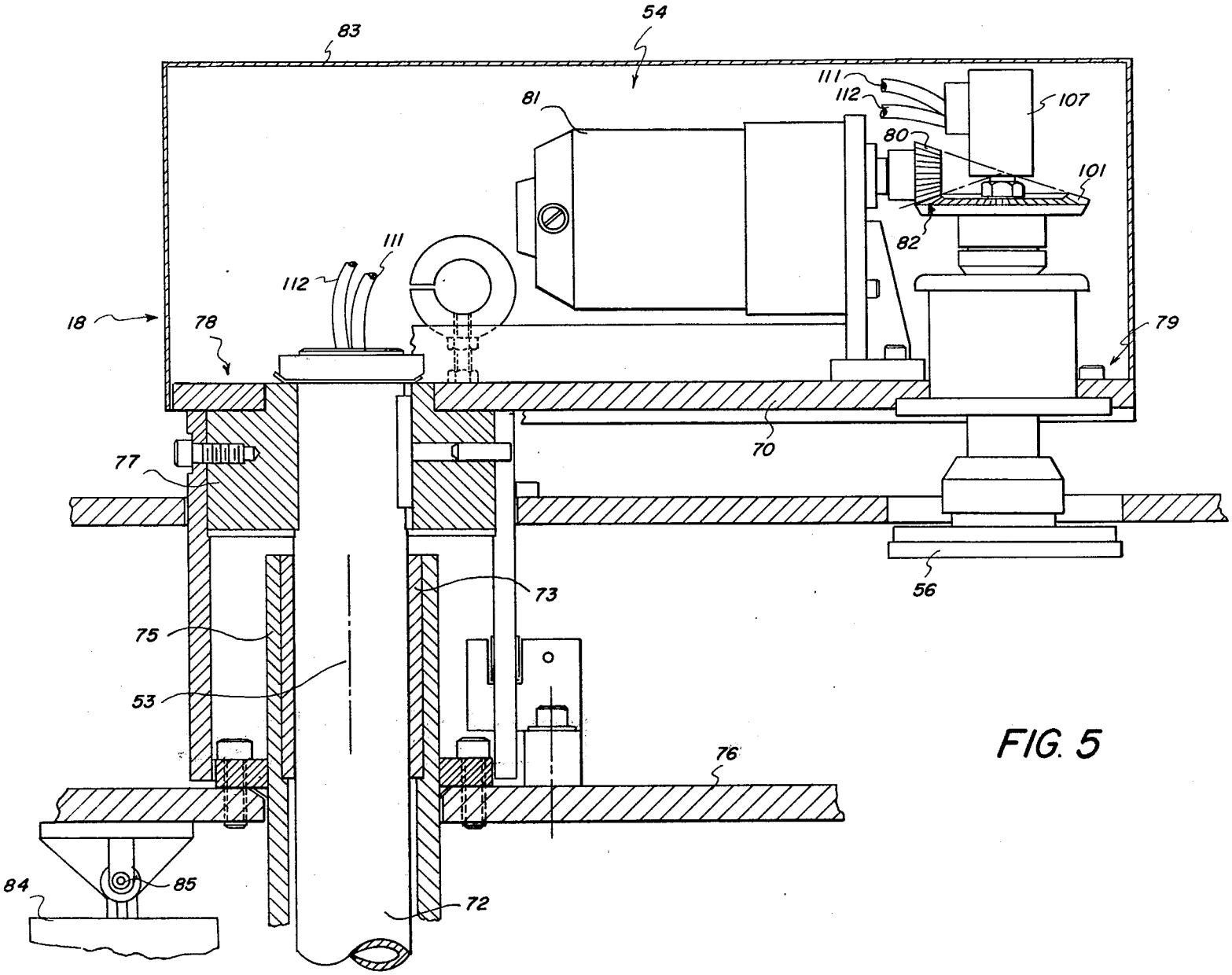
FIG. 5 is a view partially in section taken along line 5—5 in FIG. 1 and showing the upper portion of the carrier with the pressure head and the common axis about which the carrier is rotatable.
Figure 6:
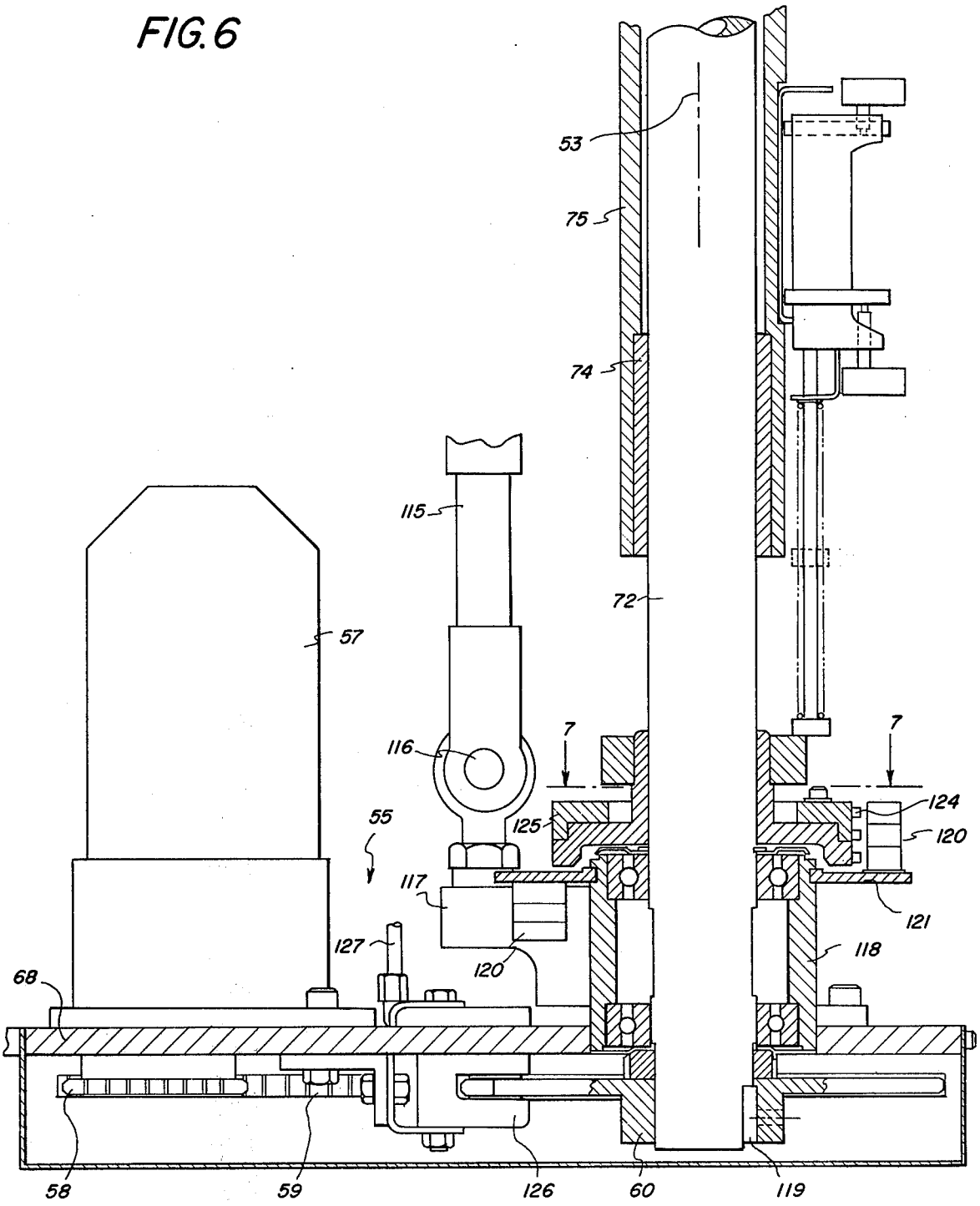
FIG. 6 is a partial vertical sectional view which is a continuation of and shows the lower portion of the carrier shown in FIG. 5.

As shown in FIG. 5, the carrier 18 comprises the upper structure 54 and a lower structure 55 as shown and about to be described with respect to FIG. 6. The common axis 53 comprises the axis of a hollow shaft 72 that is mounted in bearings 73 and 74 contained in the ends of a sleeve 75 that is mounted on a plate 76. The upper end of the shaft 72 carries a collar 77 which supports a plate 70 in a cantilever manner at the end 78. At the other or free end 79, a motor 81 is mounted on plate 70 and, through a gear drive 82, the pressure head 56 is continuously rotated while in any one of the stations 15, 16, and 26. This mechanism is enclosed by a cover 83. The plate 76 has a pneumatic cylinder 84 universally mounted on the under side thereof at 85.

The pressure head 56 comprises a member 87 having a central, hollowed recess 88 formed in the flange portion 89 and which is covered by a plate 90 to form a chamber 86. It will be noted that the plate 90 sets in a recess 91 in the member 87. The surface 92 of the plate 90, which faces the polishing surfaces 38, 48, is covered with a material 93 that has a rubberized backing and a nap surface 94 facing the polishing surfaces. The material 93 is secured to the surface 92 of the plate 90 by a suitable adhesive. The plate 90 and the material 93 are provided with a plurality of aligned holes 95. The recess 91 in the member 87 is bordered with a shim 96 and a ring 97 which provide a definite relation between the thickness of the wafer W and the distance the surface 98 of ring 97 extends beyond the plane of the nap surface 94. The ring 97 is made of a soft, plastic material and the portion 99 which extends beyond the nap surface 94 serves as a means for confining the wafer W to an area defined by the inner diameter of ring 97. Hence, any extraneous force that may be generated within by rotation of the pressure head 56, by rotation of disks 36, 45 and/or by rotation of wafer W cannot cause the wafer to be spun off into one of the pans 39, 47. Also, the wafer W is confined to an area of the abrasive surfaces 38, 48 between their rotational axes and peripheries corresponding to the inner diameter of ring 97.

Figure 8:
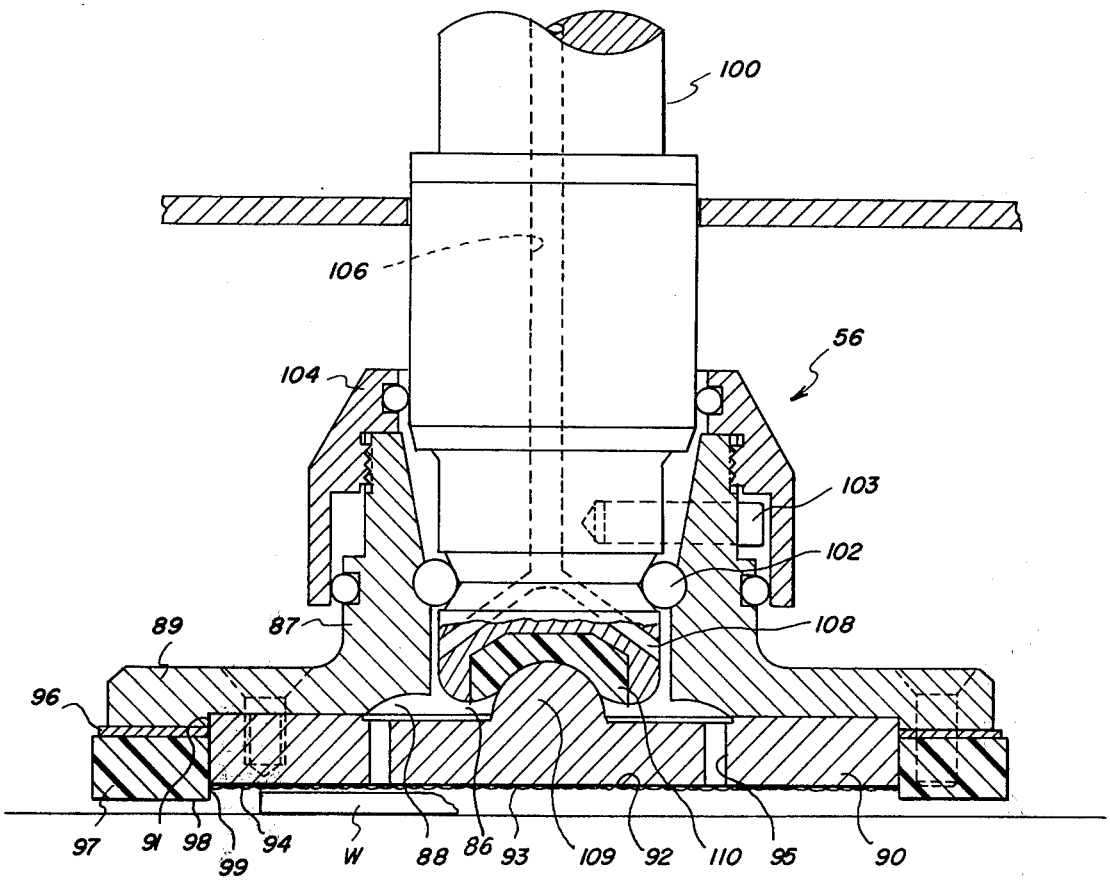
FIG. 8 is a partial sectional view showing the pressure head forming a part of and rotatable with the carrier means and the detail structure thereof for permitting a liquid, vacuum and air to be applied to the material forming a wafer contacting surface thereof.

A shaft 100 is fixed to a gear 101 shown in FIG. 5, which meshes with a gear 80 associated with the motor 81 and forming the gear drive 82. It will be noted that the shaft 100 is mounted on bearings 102 within member 87, as seen in FIG. 8, and keyed thereto by a pin 103.

The shaft 100 and member 87 are interconnected and maintained as a rotatable unit by a bearing cap 104. The shaft 100 is provided with a central bore 106 which extends from a control valve 107 to a plurality of radiating holes 108 which terminate near the bottom of the shaft 100, see FIG. 8. The member 87 is provided with a central, semi-spherical portion 109 which, in an assembled relation, engages a mating plastic, semi-spherical insert 110 carried by the end of the shaft 100. It will be noted that the holes 108 terminate close to the end of the shaft and above the chamber 86. Through the control valve 107, water and a vacuum can be applied to the chamber 86. The interconnection to the valve 107 is by means of a series of flexible hose lines 111 and 112 which are brought up and through the hollow shaft 72 to the valve 107. The control valve 107, via a programming cycle, will admit to the chamber 86 either a liquid or a vacuum in accordance with the requirements of the program.

When a liquid is supplied, as programmed, by the valve 107, it is introduced into the chamber 86 and via the holes 95 wets the material 93. This wetting of the material 93 serves to enhance the adhesion between the wafer W and the nap surface 94 of the material 93. In this way, the rotary motion of the member 87 and plate 90 can be readily imparted to the wafer W. If there is any tendency for the wafer to ride toward the periphery of the plate 90, it is confined by the ring 97 and, hence, to a predetermined area of the polishing surfaces 24, 25. Since the pressure head 56 is also movable with the carrier 18 in a vertical direction, about to be described hereinafter, the pressure with which the wafer W is maintained against the polishing surfaces 38, 48 can be with a predetermined pressure in accordance with the thickness of the wafer and the rapidity with which the polishing surface is to remove the material from the surface of the wafer. It is to be understood that the surface 98 of the ring or collar 97 can be positioned with respect to the nap surface 94 in a number of ways other than by providing the shim 96. For example, the ring 97 can be threaded and locked to the flange portion 89 or to the plate 90 so as to make ring 97 vertically adjustable. Also, a number of studs carried by the flange portion 89 and threadably engaging the ring 97 will serve to move the ring 97 toward or away from the portion 89 to provide the necessary shoulder to confine the wafer W as described above.

With reference to FIG. 6, the pneumatic cylinder 84 shown in FIG. 5 is provided with a piston having an operating arm 115 which is pivotally mounted at 116 to a bracket 117 carried by the bearing support 118 mounted on the plate 68. As described above, the plate 68 carries the motor 57 which, through the pulley or sprocket 58, the belt or chain 59 and sprocket or pulley 60, rotates the hollow shaft 72 having the common axis 53. As a result, rotation of the pulley 60, which is keyed at 119 to shaft 72, rotates shaft 72 and also plate 70 which is also keyed thereto at the upper end, see FIG. 5. The carrier 18 is rotated through an arc which moves the pressure head 56 over each of the stations between the pickup station 13 and the receiving station 17. Also, upon actuation of the pneumatic cylinder 84 in the course of a cycle of operation, the carrier 18, including the upper structure 54 and the lower structure 55 are lowered vertically to position the pressure head 56 for picking up and ejecting a wafer, for holding a wafer in contact with polishing surfaces 24, 25, and for holding the nap surface 94 in contact with brush 26 and is moved and held in a raised position for transporting a wafer W relative to the stations. The arcuate movement of carrier 18 in a horizontal plane is controlled by suitable timing circuitry which are arranged in spaced relation about shaft 72 on a fixed plate 121. Switches 120 control the functions performed in each station. The switches 120 are arranged in clusters on both sides of plate 121, as seen in FIG. 6. As will be described, the switches 120 are actuated by contacts, generally designated by the numeral 124, which are carried by a contact plate 125 movable with shaft 72 and carrier 18. A pneumatically operated brake 126, which engages pulley or sprocket 60, serves to prevent any overrun of the carrier 18 and pressure head 56 in any one of the stations and, hence, ensures accurate positioning of the pressure head 56 in the various stations. This brake is pneumatically operated by an air line 127 associated therewith.

Figure 7:
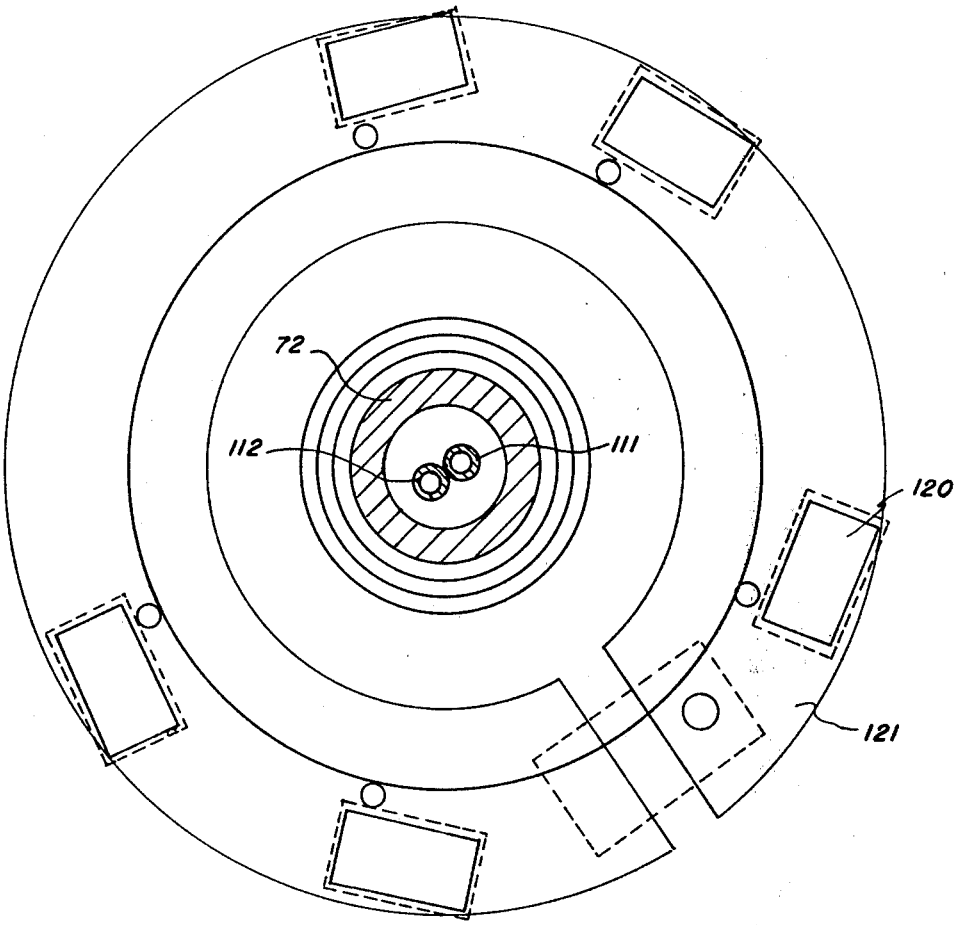
FIG. 7 is a cross sectional view taken along line 7—7 in FIG. 6 and shows the arrangement of the limit switches on the carrier for controlling the functional operation of the polishing apparatus.

In FIG. 7 the plate 121 is shown with the clusters or groups of control switches 120 arranged thereon. These switches are stacked on both the top and bottom sides of the plate 121 in order to provide the necessary number of control positions related to each respective station. As noted hereinabove, the plate 121 remains fixed relative to the shaft 72 so that the contacts 120 on plate 125 are moved relative to the switches, thereby providing for more accurate timing of the function controlled by each switch in each station.

A description of a cycle of operation will now be described with respect to the block diagram shown in FIG. 9. It will be appreciated that the switching and timing circuitry required to perform the operations about to be described would be familiar to one skilled in the art and, hence, any circuitry details per se will not be described. However, it should be stated, as is well known in the art, such circuitry can contain timing elements or circuits that can be pre-set or adjusted so as to limit the operation of a particular function when the carrier 18 is positioned relative to any one of the stations 13–17. Such predetermined time intervals are required in the pickup station 13 for wetting of the nap surface 94 of the material 93, for application of a vacuum to the pressure head 56, for picking up the wafer W, and for completion of the pickup operation and ultimate movement of the carrier 18 with the wafer W to another station. It should also be pointed out at this time that the operation of the carrier 18 is the same in each respective station; that is, the carrier 18 is normally maintained in a raised or transporting position and in this position is moved from one to the other of the stations and in each station is moved in a downward direction. Again, the pressure with which the carrier 18 and, hence, the pressure head 56 is urged against a wafer in station 13, is urged against the cleaning brush 26 in the cleaning station 14, is urged toward the disks 36 and 45 in either the primary or secondary stations 15 and 16, and is urged toward the receiving station 17 is dependent on the rapidity with which the polishing operation is to be performed and is a pressure that can be adjusted by the operator in accordance with the wafer material, the wafer thickness and the amount of material to be removed.

A stack of wafers is normally maintained in the pickup station 13 and these wafers are maintained in a stack on a resiliently supported plate. The carrier 18 is normally maintained in a start position over the pickup station. Air is normally applied to the pneumatic cylinder 84 via line L1 through a filter 130 and via line L2 to a solenoid operated valve 133 for application to the underside of the piston 132 via line L3 for maintaining the carrier 18 in its raised or transporting position. While the carrier 18 is held in this position, the solenoid actuated valves 133, 134 and 135 are normally de-energized. The operator actuates a start button on the housing 19 and a cycle is started. The carrier 18 must be moved downward so as to position the nap surface 94 on the pressure head 56 in contact with the uppermost wafer W on the stack in the pickup station 13. This is accomplished with the energization of solenoid valve 133 and solenoid valve 135. In this way, the air is now introduced via line L4 to the line L5 and L6 for applying air to the upper portion of the piston 132, thereby moving it downward and therewith the carrier 18 and pressure head 56. When the carrier 18 has moved a predetermined distance in a downward direction, a switch 136 is actuated (see FIG. 6), thereby de-energizing solenoid valve 135, but maintaining energization of solenoid valve 134. The carrier 18 continues to move downward a short distance and into contact with the uppermost wafer W due to the unbalanced weight of the carrier relative to the pressure exerted by the pneumatic cylinder 84 and this unbalanced weight is utilized to move the pressure head 56 the remainder of the distance toward the wafer. At the time the carrier 18 is starting to move in a downward direction, the solenoid valve 140 is energized to provide a flow of water via line 112 to the control valve 107. As described hereinabove, this flow of water is utilized to wet the nap surface 97 of the material 93 so as to provide a more adhesive surface for contacting the wafer to be polished. Also, solenoid valve 141 is actuated to provide a flow of water to the aspirator 142 so that a vacuum or suction is applied to control valve 107 via line 111. It has been described hereinabove that a liquid and a vacuum are applied to control valve 107 via lines 111 and 112, for application of these media to the central bore 106 of the pressure head 56. The application of the water and the vacuum are in a specific timed relation and for a predetermined interval of time, the application of the water preceding that of the vacuum. The vacuum is maintained until the wafer has been positioned in the station in which the polishing operation is to be performed and also serves to withdraw any excess water through the line 111 for removal through the drain for the aspirator 142.

After the nap surface 94 of material 93 has been wetted, the vacuum applied to the pressure head 56, and the carrier 18 moved in a downward direction until in contact with a wafer, solenoid valves 133 and 135 are de-energized so as to again allow application of air to the underside of the piston 132, thereby raising the carrier 18. The solenoid 141 is maintained in an energized position in order to maintain the vacuum to the pressure head 56. When the carrier 18 is in its raised position, the motor 57 is energized to rotate the carrier 18 relative to the stations. Depending on the programming of the cycle of operation, the carrier 18 is moved over the cleaning station 14 and into position relative to the primary station 15. When in this position, the carrier 18 is lowered toward the disk 36 in the manner already described. Also, when the carrier 18 moves into a position relative to the polishing or primary station 15, the contacts 124 actuate the switches in the primary station position to provide a cycle of operation in that station within predetermined time intervals and in a particular order. As the carrier moves downward, the motor 81 is energized for imparting rotation to the pressure head 56 and to the wafer carried therewith. The wafer is positioned in contact with the abrasive material 37 on the disk 36 between the periphery of the disk and its axis of rotation, the disk being continuously rotating during the operation of the apparatus. When the wafer is in contact with the abrasive material 37, the solenoid 141 is de-energized to remove the vacuum and the wafer is held between the wetted material 93 and the surface of the abrasivve material 37 with sufficient friction so that the rotary motion of the pressure head 56 is imparted to the wafer. At the time the wafer engages the abrasive material 37, the solenoid valve 145 is energized for a period of time and releases a slurry of cutting compound for application via line L7 to the surface of the disk 36 in the polishing station 15. The polishing operation continues for a predetermined period of time and then solenoid valve 146 is energized for a specified time to allow a flow of rinse water to be applied to the disk 36 via line L8 and, at substantially the same time, the solenoid valve 45 is de-energized to cut off the flow of the slurry of cutting compound. Solenoid 141 is then energized to again apply the vacuum to the pressure head 56 to hold the wafer thereon during its movement to another station. The motor 81 is de-energized also. The carrier 18 and pressure head 56 are then raised with actuation of the pneumatic cylinder 84 to again place the carrier in its transporting position, as previously described.

If the cycle of operation includes a secondary polishing of the wafer W in the station 16, then with energization of the motor 57 and movement of the carrier 18 to a position relative to the secondary station 16, the carrier 18 is brought to a stop and again the contacts 124 actuate the switches 120 arranged relative to this station. Again, the carrier 18 is lowered into a position wherein the wafer is placed in contact with the abrasive material 46 on disk 45, the vacuum is released, and the motor 81 is energized to impart rotation to the pressure head 56 and wafer W. Also, the solenoid valve 147 is energized for a period of time to release a flow of a slurry of cutting compound via line L9 to the surface of the disk 45 and the abrasive material 46 thereon. Upon completion of the polishing operation, solenoid valve 148 is energized for a period of time to apply a flow of rinse water via line L9 to disk 45. The raising of the carrier 18 and the pressure head 56 to move the wafer W out of contact with the disk 45 is accomplished in the manner already described. Again, with the carrier 18 moved into its raised or transporting position, the motor 81 is de-energized, and the motor 57 is energized to move the carrier and the wafer on the pressure head 56 into the receiving station 17. In this station, the contacts 124 again actuate a set of switches, whereby the solenoid valve 141 is de-energized to remove the vacuum from the pressure head 56 and the solenoid valve 148 is again energized to apply a flow of water to the pressure head 56 via line 112 and control valve 107 for removing the wafer from the nap surface 94, the water negating the frictional force with which the wafer W is held on the nap surface 94. As noted hereinabove, a flow of air under slight pressure can also be used.

Once the wafer has been deposited in the receiving station, the carrier 18 is again moved upward into a transporting position and the motor 57 is energized for rotation in a reverse direction so as to move the carrier 18 toward the pickup station 13. In this direction of movement, the carrier 18 moves over stations 16 and 15 and comes to a stop with respect to the cleaning station 14. In this station, the carrier 18 is again moved downwardly toward the brush 26 until the nap surface 94 of the material 93 on the pressure head 56 is brought into contact with the brush 26. At this time, the solenoid valve 150 is energized to permit a flow of water to be applied via line L10 to the brush so as to scrub the nap surface 94 so as to remove therefrom any particles of the wafer material and/or of the slurry compound. After the time allotted for cleaning the nap surface 94 on the pressure head 56, the carrier 18 is again raised to a transporting position and the motor 57 is energized to move the carrier 18 into the pickup station 13 for repeating another cycle of operation with respect to another wafer.

It should be pointed out, however, that the pressure with which the pressure head 56 maintains the wafer W in contact with the abrasive surfaces 38 and 48 and nap surface 94 in contact with brush 26 is dependent on the combination of valves 133, 134, and 135 that is energized. As described above, the energization of solenoids 133 and 135 were utilized to provide a low press or low pressure to the pressure head 56. However, by suitable programming, if a higher pressure is desired, then in each station, the energization of solenoids 134 and 135 will be utilized. This is a matter of programming and can be changed by the operator at the beginning of any cycle of operation.

Figure 9:
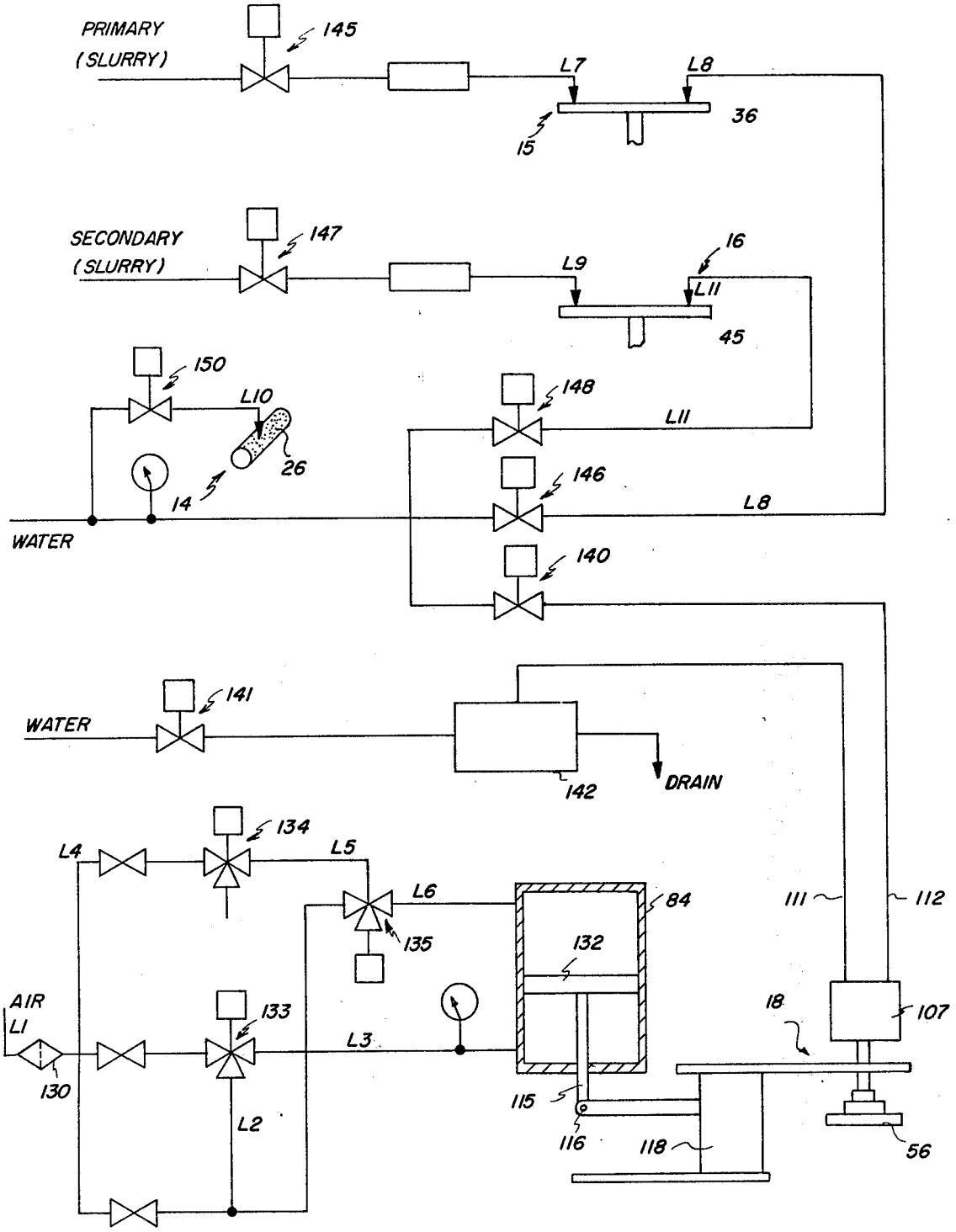
FIG. 9 is a block and schematic diagram showing the interlocking controls for the polishing apparatus and the manner in which a cycle of operation can be programmed for polishing a surface of the wafer in either one or both of the primary and secondary polishing stations.

It is to be understood that various types of flow indicators, pressure gauges, and other indicators of various conditions can be provided in the system for operation and control and do not form any part of the invention and therefore have not been described in any detail, but in some instances have been indicated as in FIG. 9. Also, it should be evident that the apparatus described hereinabove provides for readily and efficiently handling wafers of a semi-conductive material with the advantages already described.

The invention has been described in detail with particular reference to preferred embodiments thereof, but it will be understood that variations and modifications can be effected within the spirit and scope of the invention.

We claim:

1. Apparatus for polishing one surface of a thin, flat wafer of a semi-conductive material, comprising:

a plurality of stations arranged in angularly spaced and circular relation to a common axis, including a wafer supply station, a cleanup station having a rotatable brush, a primary polishing station having a rotatable polishing surface, a secondary polishing station having a rotatable polishing surface, and a polished wafer receiving station;

drive means interconnected to the primary polishing and secondary polishing stations for rotating the polishing surface in the respective stations;

carrier means pivotally mounted with respect to the common axis and movable in an arcuate path over each of the stations and in a vertical direction when positioned in a predetermined relation to one or more of the stations, the carrier means including a pressure head at the free end thereof for engaging the other surface of the wafer for supporting and holding the same, first drive means for continuously rotating the head, and second drive means for moving the carrier means through the arcuate path;

means operatively connected to the carrier means for oscillating the pressure head in a small arcuate path when the pressure head is in the primary polishing station and while the pressure head is being rotated;

means operatively connected to the carrier means for moving and holding the same in a vertically raised position during movement of the carrier means from one station to another and for maintaining the carrier means in a vertically lowered position in each respective station for picking up a wafer, for holding a wafer with a predetermined pressure in contact with an area between the rotational axis and the periphery of each polishing surface, for ejecting the wafer in the receiving station and for scrubbing the pressure head in the cleaning station;

means operatively connected to the carrier means for successively applying a flow of liquid, a vacuum and a flow of air to the pressure head; and means operatively connected to the carrier means, the oscillating means, the moving and holding means and the applying means for controlling a sequential cycle of operation to at least transport, position and polish the one surface of the wafer.

2. The apparatus in accordance with claim 1 wherein the pressure head is self-levelling and is provided with a chamber having a perforated surface for engaging the other surface of the wafer.

3. The apparatus in accordance with claim 2 wherein the perforated surface is covered with a correspondingly perforated rubberized material having a nap surface of high friction for engaging the other surface of the wafer.

4. The apparatus in accordance with claim 3 wherein the applying means is connected to the chamber, the flow of liquid being applied to the material prior to pickup of a wafer to enhance the retention of the wafer by the material during rotation of the pressure head, the vacuum being applied during movement of the wafer from one station to the other and the flow of air being applied when the carrier means is in the receiving station for ejecting the wafer from the pressure head.

5. Apparatus in accordance with claim 1 wherein the oscillating means is selectively connected to any one of several positions on the carrier means to vary the amount of oscillation in accordance with the thickness of the wafer.

* * * * *